US010981347B2

(12) United States Patent
Brenkus et al.

(10) Patent No.: US 10,981,347 B2
(45) Date of Patent: Apr. 20, 2021

(54) METHOD AND APPARATUS FOR RESEALABLE PACKAGE WITH INTERNAL ZIPPER SEAL

(71) Applicant: Frito-Lay North America, Inc., Plano, TX (US)

(72) Inventors: Frank Mathew Brenkus, McKinney, TX (US); Chad Arthur Huebner, Bedford, TX (US)

(73) Assignee: Frito-Lay North America, Inc., Plano, TX (US)

( * ) Notice: Subject to any disclaimer, the term of this patent is extended or adjusted under 35 U.S.C. 154(b) by 993 days.

(21) Appl. No.: 15/045,886

(22) Filed: Feb. 17, 2016

(65) Prior Publication Data

US 2017/0233125 A1 Aug. 17, 2017

(51) Int. Cl.

| | |
|---|---|
| ***B31B 70/81*** | (2017.01) |
| ***B65B 61/18*** | (2006.01) |
| ***B65B 9/20*** | (2012.01) |
| ***B31B 70/26*** | (2017.01) |
| *B65B 51/30* | (2006.01) |

(52) U.S. Cl.

CPC ..... *B31B 70/8131* (2017.08); *B31B 70/262* (2017.08); *B31B 70/28* (2017.08); *B31B 70/813* (2017.08); *B31B 70/8133* (2017.08); *B31B 70/8136* (2017.08); *B65B 9/20* (2013.01); *B65B 9/2014* (2013.01); *B65B 61/188* (2013.01); *B65B 51/30* (2013.01)

(58) Field of Classification Search

CPC ..... B65B 61/188; B65B 9/20; B65B 9/2014; B65B 51/30; B31B 70/262; B31B 70/28; B31B 70/813; B31B 70/8131; B31B 70/8133; B31B 70/8136

USPC ..... 53/412

See application file for complete search history.

(56) References Cited

U.S. PATENT DOCUMENTS

| | | | | | |
|---|---|---|---|---|---|
| 4,355,494 | A * | 10/1982 | Tilman | B29C 65/18 | 493/194 |
| 4,512,138 | A * | 4/1985 | Greenawalt | B29C 65/02 | 219/243 |
| 4,532,754 | A * | 8/1985 | Hokanson | B65B 9/213 | 383/200 |
| 4,617,683 | A | 10/1986 | Christoff | | |
| 4,655,862 | A | 4/1987 | Christoff | | |
| 4,666,536 | A | 5/1987 | Van Erden | | |
| 4,682,366 | A | 7/1987 | Ausnit | | |
| 4,759,642 | A | 7/1988 | Van Erden | | |
| 4,909,017 | A * | 3/1990 | McMahon | B65B 61/188 | 156/66 |
| RE34,347 | E | 8/1993 | Van Erden | | |
| 5,322,579 | A * | 6/1994 | Van Erden | B65B 9/20 | 156/251 |

(Continued)

*Primary Examiner* — Sameh Tawfik

(74) *Attorney, Agent, or Firm* — Barnes & Thornburg LLP; G. Peter Nichols

(57) ABSTRACT

Embodiments of the present disclosure describe a method and apparatus for a resealable package having an internal zipper seal. In one embodiment, the apparatus is a vertical form, fill, and seal machine that includes a former, a vertical sealer, and a zipper separation blade located between the former and the vertical sealer. The zipper separation blade further comprises a connector and a blade body that defines a zipper gap between an exterior surface of the former and the blade body.

17 Claims, 11 Drawing Sheets

(56) References Cited

U.S. PATENT DOCUMENTS 5,412,924 A * 5/1995 Ausnit ..... B65B 9/20 53/133.4
5,417,035 A * 5/1995 English ..... B65B 9/20 383/200
5,473,866 A * 12/1995 Maglecic ..... B65B 1/22 53/151
5,768,852 A * 6/1998 Terminella ..... B65B 9/20 53/133.4
5,816,018 A 10/1998 Bois
6,029,428 A 2/2000 Terminella
6,032,437 A 3/2000 Bois
6,131,369 A * 10/2000 Ausnit ..... B65B 9/20 493/213
6,131,374 A * 10/2000 Bois ..... B65B 9/20 493/214
6,371,644 B1 4/2002 Forman
6,393,804 B1 5/2002 Ausnit
6,523,325 B1 2/2003 Forman
6,572,267 B1 6/2003 Forman
6,634,158 B1 * 10/2003 Bois ..... B65B 9/20 53/551
6,715,262 B2 * 4/2004 Malin ..... B65B 9/20 53/133.4
6,986,920 B2 1/2006 Forman
7,305,805 B2 * 12/2007 Dierl ..... B65B 9/20 53/133.4
7,638,152 B1 12/2009 Jurgovan
7,908,826 B2 * 3/2011 Reaves ..... B65B 9/2028 53/451
8,740,458 B2 * 6/2014 Edwards ..... B65B 51/146 383/109
8,784,289 B2 7/2014 Greco
9,238,537 B2 * 1/2016 Edwards ..... B65B 9/2056
2004/0060638 A1 4/2004 Johnson
2007/0258665 A1 11/2007 Greco
2010/0111453 A1 * 5/2010 Dierl ..... B65B 9/213 383/204

* cited by examiner

METHOD AND APPARATUS FOR RESEALABLE PACKAGE WITH INTERNAL ZIPPER SEAL

BACKGROUND OF THE INVENTION

Technical Field

The present invention relates generally to snack packages. More particularly the disclosure herein describes a resealable package with an internal zipper seal spanning substantially the entire width of the package. The disclosure also provides for a film usable for forming the package, methods of manufacture, and a corresponding apparatus for manufacturing the package.

Background

Snack items, such as chips and pretzels, are commonly stored in packages colloquially referred to as pillow pouches. Pillow pouches are aptly named packages that resemble pillows when filled with snack items and an inert gas, which forms a protective bubble limiting breakage and loss of desirable organoleptic properties. The two components of pillow pouches responsible for maintaining the protective bubble are the impermeable packaging film and the hermetic seals, at least one of which is a back seal located on the rear panel of the package, extending from an upper transverse seal to a lower transverse seal.

Pillow pouches are commonly formed using a vertical form, fill, and seal machine (VFFS). A continuous roll of film is fed into the VFFS, which transforms the film into a package, applies a set of hermetic seals that define an interior region, which may then be filled with food items before the package is completed, separated from an upstream bag, and prepared for distribution.

If the contents in the package cannot be finished in a single sitting, then the package is often resealed by folding down the opened end of the package and applying a clip that forms a temporary seal. However, this method is inconvenient because the bag clip is oftentimes not readily available and the package is secured at only a single point corresponding to the clip location, which may allow air to penetrate the interior region of the package, reducing the shelf-life of the package contents.

SUMMARY OF THE INVENTION

In a first embodiment, the disclosure describes an apparatus for forming a resealable package. In an aspect of the third embodiment, the disclosure describes an improved vertical form, fill, and seal machine for forming a resealable package. The vertical form, fill, and seal machine includes a former, a vertical sealer, and a zipper separation blade located between the former and the vertical sealer. The zipper separation blade further comprises a connector and a blade body that defines a zipper gap between an exterior surface of the former and the blade body.

Another aspect of the first embodiment describes a zipper separation blade having a blade body and a connector extending from one side of the blade body. The blade body includes a first end, a second end, and a middle portion that defines a first plane. The connector defines a second plan different from the first plane.

A final aspect of the first embodiment describes a method for forming a resealable package using the improved vertical, form, fill, and seal machine. The method includes the steps of wrapping packaging film around a filling tube to form a tube of film. The unattached portion of a first zipper strip is isolated within a zipper gap while forming a back seal, then the unattached portion is rejoined to the packaging film over the newly formed back seal.

In a second embodiment, the disclosure describes a resealable package. The resealable package has a front panel, a rear panel opposite the front panel, and an upper transverse seal located at an upper end of the resealable package which extends a width between a first longitudinal edge and a second longitudinal edge of the package. A lower transverse seal is located at a lower end of the resealable package, and a back seal extends from the upper transverse seal to the lower transverse seal. Located within an interior of the resealable package is a zipper seal that spans the width of the resealable package, overlapping the back seal.

Another aspect of the second embodiment is a method of forming the resealable package from packaging film having a set of zipper strips adhered thereon. A sheet of the packaging film is formed into a tube of film, and an unattached portion of a first zipper strip is isolated from the tube of film while a back seal is formed. Thereafter, the unattached portion is reengaged with the tube of film over the back seal. A set of transverse seals is added to define an interior region of the resealable package, and an optional amount of food product may be placed therein.

In a third embodiment, the disclosure describes a packaging film usable for creating the resealable package. The film comprises a first side and a second side opposite the first side. A set of zipper strips is partially adhered to the first side, extending from a first longitudinal edge towards a second longitudinal edge, but terminating at a margin offset inwardly from the second longitudinal edge. A predetermined length of each zipper strip is unadhered at a first end to form an unattached portion.

In another aspect of the third embodiment, a method is described for forming the packaging film usable to create a resealable package of the first embodiment. The method includes providing a film having a first side bounded by a first longitudinal edge and a second longitudinal edge. A first zipper strip is partially adhered to the first side so that a first end of the first zipper strip extends perpendicularly from the first longitudinal edge towards the second longitudinal edge, but terminates at a margin offset inwardly from the second longitudinal edge. A predetermined length of the first zipper strip is unadhered at the first end to form an unattached portion.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Figure 1:
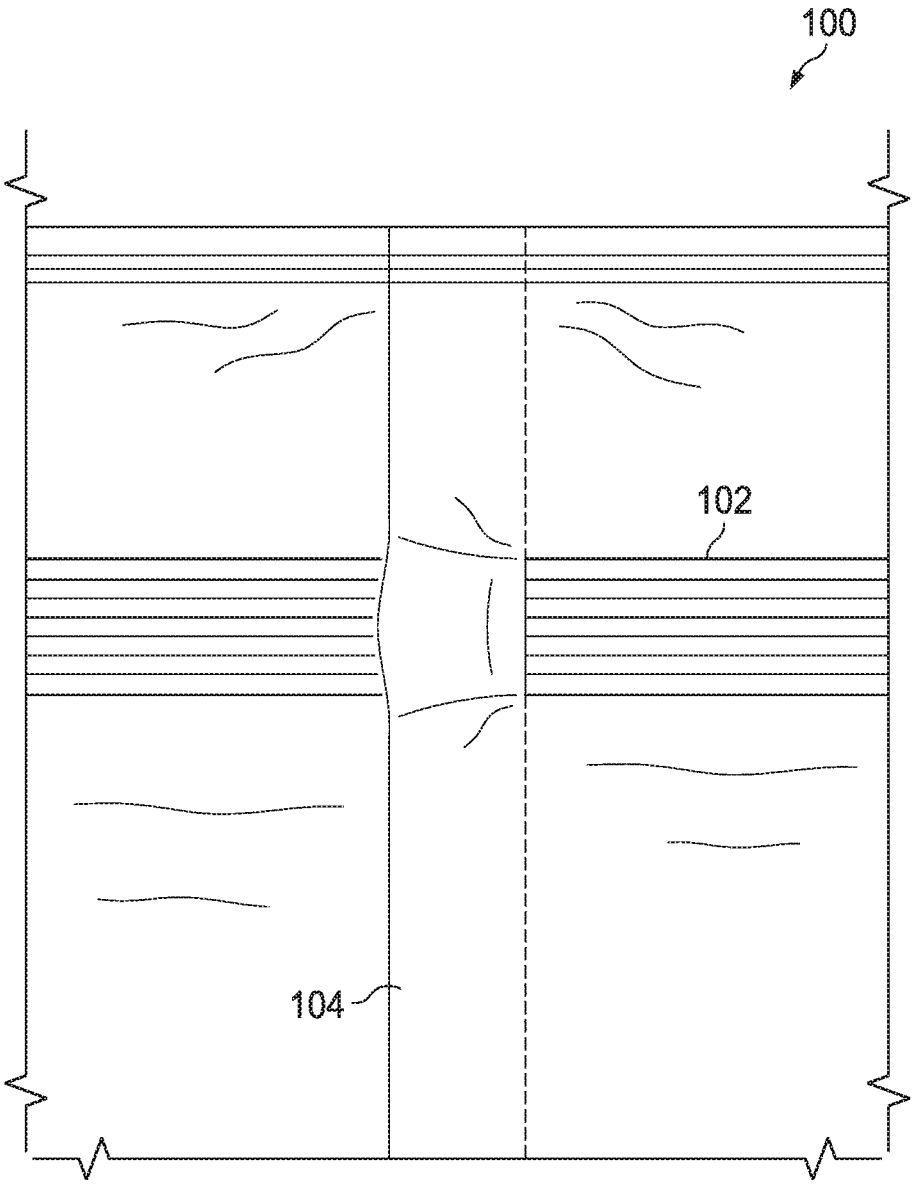
FIG. 1 (PRIOR ART)
FIG. 1 depicts the intersection of a zipper seal and a back seal in an interior of a package, which was formed from prior art methods.

The novel aspects of the present disclosure are described with reference to a resealable package, which may also be referred to herein as a "pillow pouch," having a zipper seal located within an interior of the package for re-sealing the package after opening. The incorporated zipper seal obviates the need for resealing a snack package with a bag clip, which may not always be readily accessible. In contrast, the internal zipper seal is always available and capable of forming a temporary seal that spans the width of the package.

In one embodiment, the resealable package may be formed from a vertical form, fill, and seal machine. However, the application of these novel aspects may be applied to any type of bag usable a similarly configured bag-forming apparatus. In addition, although the resealing device has been described as a zipper seal, the novel aspects described herein may be applied to any other currently existing or later developed resealing device having a similar form factor.

A zipper seal is a type of sealing device that forms a temporary seal when opposing, operative surfaces of the zipper seal are pressed together. Generally, the operative surfaces of the zipper seal have a series of complementary structures on opposing sides capable of engaging one another to form a temporary seal. The zipper seal is formed from one or more zipper strips, which may be incorporated onto a piece of film prior to forming a resealable package. Once the film has been formed into the package and the operative surfaces of the zipper strips are aligned, then the one or more zipper strips forms a zipper seal usable to reseal the package.

Prior attempts at incorporating zipper seals into pillow pouches have been unsuccessful because the back seal interferes with the formation of a contiguous zipper seal that spans the entire width of the package so that only a partial seal can be formed upon resealing. Additionally, the zipper seal interferes with the formation of the back seal, either by reducing the integrity of a hermetic back seal or by preventing the formation of a back seal having hermetic properties. These deficiencies are described in more detail in FIG. 1 below.

The back seal is located on the back panel of a snack package and extends the length of the package from the upper transverse seal to the lower transverse seal. The back seal is formed by bringing the two longitudinal edges of a sheet of packaging film together and applying pressure in the presence of heat to form a seal. There are two commonly used types of back seals, namely lap seals and fin seals. The lap seal is formed when opposite sides of the packaging film are sealed together. The fin seal is formed when the same side of the packaging film are sealed together. For example, a sheet of packaging film has a first side that eventually forms the interior surface of the package, and a second side that eventually forms the exterior surface of the package. The lap seal is formed by sealing a portion of the first side, located at one of the longitudinal edges, onto a portion of the second side, located at the opposite longitudinal edge. Likewise, the fin seal is formed by sealing a portion of the first side, located at one of the longitudinal edges, onto another portion of the first side, located at the opposite longitudinal edge. Embodiments of the present disclosure are described with reference to a resealable package having a lap seal; however, a fin seal could also be substituted.

FIG. 1 depicts an interior surface of the back panel of a package 100 formed from prior art methods. As can be seen, the continuity of the zipper seal 102 is interrupted by a layer of film forming the back seal 104, which prevents the package 100 from resealing along the entire width. The imperfect zipper seal 102 has a gap that corresponds approximately to the width of the back seal 104 and allows the contents of the package 100 to be exposed to environmental conditions upon partial resealing, promoting the loss of desirable organoleptic properties.

The prior art bag-forming methods also result in an imperfect back seal 104, which is interrupted by a portion of the zipper seal 102 sandwiched between the corresponding layers of film. Consequently, the interfering zipper seal 102 may prevent the formation of a hermetic back seal 102, or if a hermetic seal can be formed nonetheless, the imperfect back seal 104 may be unnecessarily weakened at that location and be more susceptible to failure.

The present disclosure recognizes the deficiencies described above and provides for a resealable package having an uninterrupted back seal, and a zipper seal that spans substantially the entire width of the package, with an allowance for manufacturing tolerances. Exemplary embodiments are presented in FIGS. 2*a*-2*c* that follow.

Figure 2B:
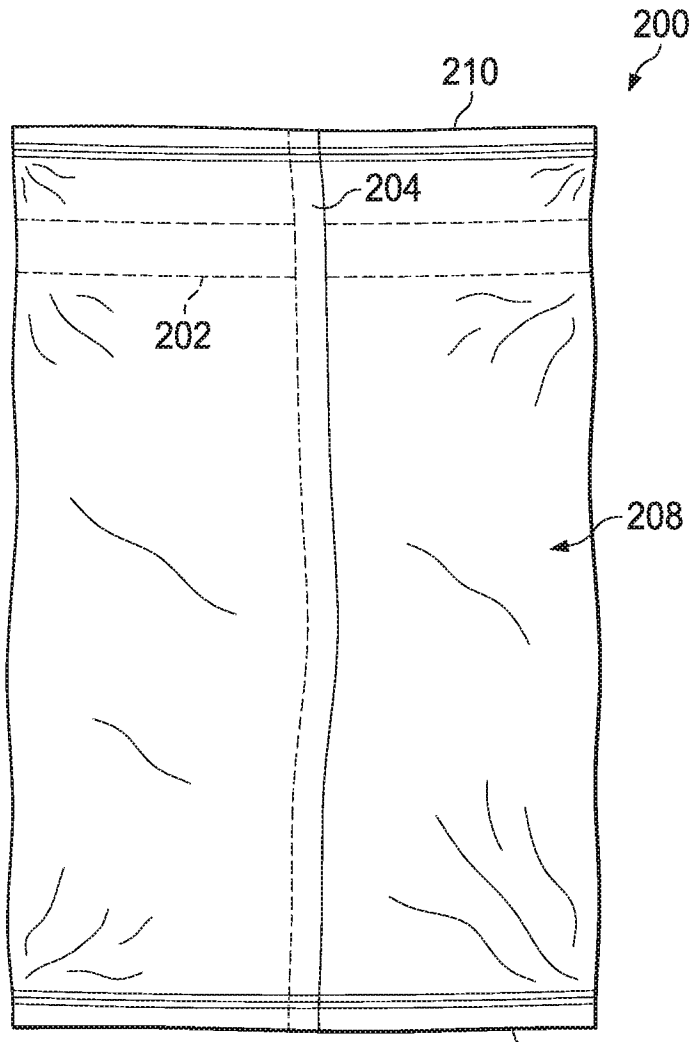
FIGS. 2*a*-2*c* depicts multiple views of a resealable package in accordance with an illustrative embodiment.
Figure 2A:
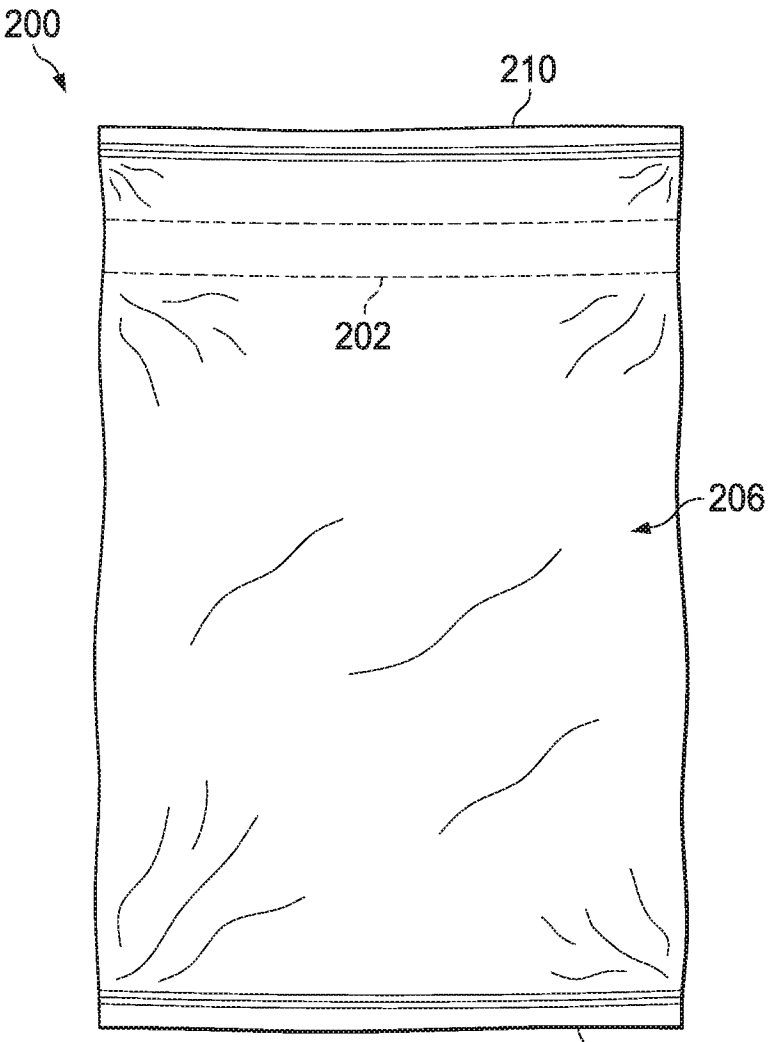
Figure 2C:
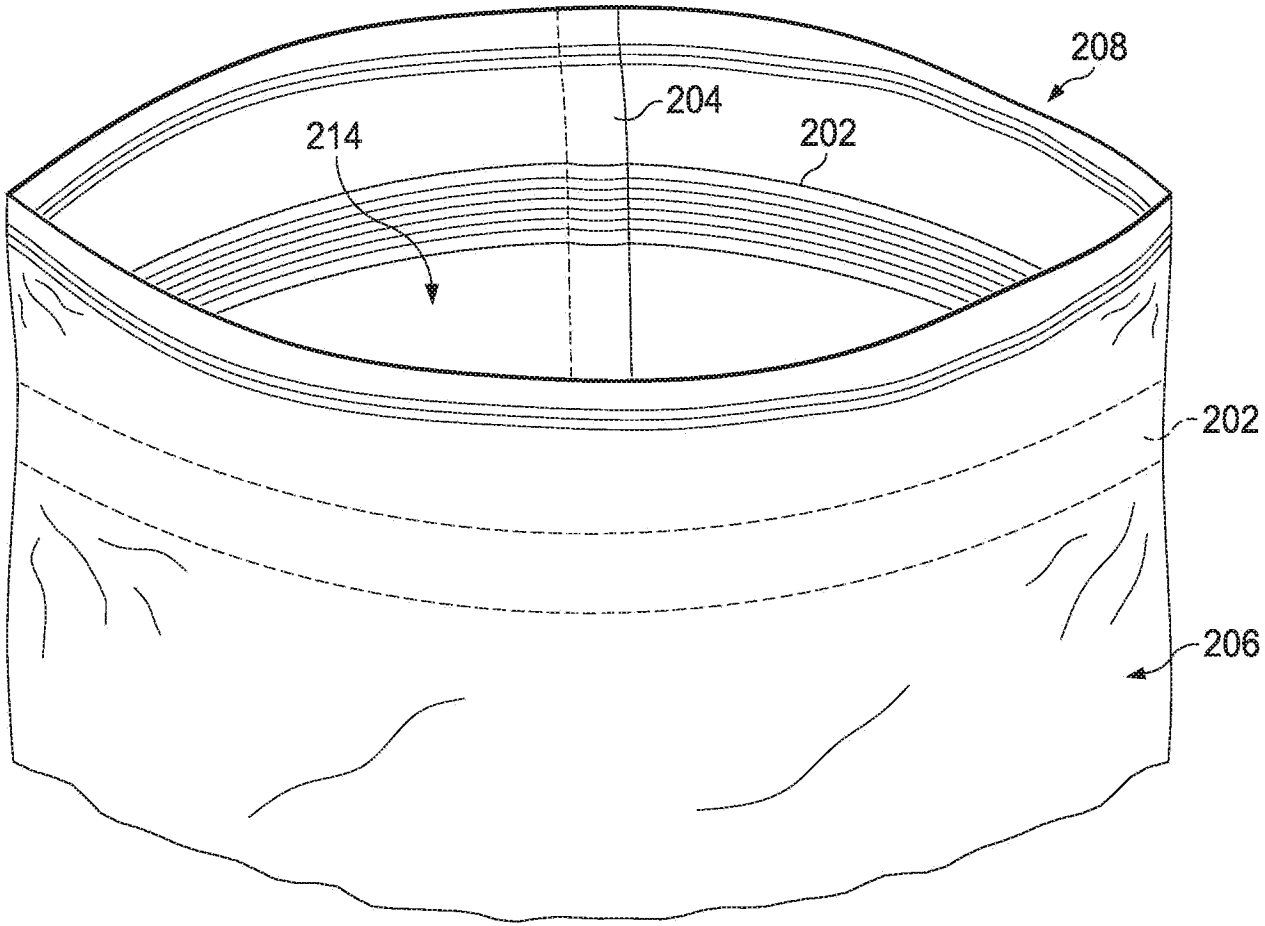

FIGS. 2*a*-2*c* depict alternate views of a resealable package in accordance with an illustrative embodiment. In particular, FIGS. 2*a* and 2*b* depict a front view and back view of the resealable package 200, respectively. FIG. 2*c* shows a perspective view of a portion of the interior of the resealable package 200, which includes a zipper seal 202 that spans the width of the resealable package 200, and a hermetic back seal 204 that is uninterrupted by any portion of the zipper seal 202.

With particular reference to FIGS. 2*a* and 2*b*, resealable package 200 is shown having a front panel 206 and a rear panel 208, both of which are bounded at the top by an upper transverse seal 210 and at the bottom by a lower transverse seal 212. Back seal 204 is located on the rear panel 208, extending the length of rear panel 208 from the upper transverse seal 210 to lower transverse seal 212.

Front panel 206 and back panel 208 each includes an exterior surface and an interior surface. The interior surfaces of the front panel 206 and the back panel 208 define an interior region 214 of the resealable package 200 for storing food pieces. Further, adhered to the interior surfaces of resealable package 200 is zipper seal 202, which is located between upper transverse seal 210 and lower transverse seal 212 and substantially parallel with both. In one embodiment, the zipper seal 202 is located at least in the upper half of the resealable package 200, more particularly the zipper seal 202 is located in the upper third of the resealable package 200. Zipper seal 202 is usable to reseal the resealable package 200 after opening.

In FIGS. 2*a* and 2*b*, the relative placement of zipper seal 202 within resealable package 200 is shown by broken lines appearing on the exterior surface of the package. To reseal the resealable package 200 after opening, the opposing surfaces of the zipper seal 202 are aligned and pressure is exerted on the exterior of resealable package 200 and advanced along a length of the zipper seal 202, which coincides with the path depicted by the broken lines. In this manner, the opposing surfaces of the zipper seal 202 are detachably engaged with one another, forming a temporary seal.

FIG. 2*c* depicts a perspective view of resealable package 200 in an opened state, which partially shows the interior region 214 of the resealable package 200 in accordance with an illustrative embodiment. As can be seen, zipper seal 202 extends the entire width of the resealable package 200, unlike the prior art zipper seal 102 that was partially concealed by the back seal 104, as was shown previously in FIG. 1. Further, the integrity of the back seal 204 is maintained and the hermetic properties are preserved because the back seal is formed without interruption from zipper seal 202.

The dimensions of the resealable package 200 may vary based upon a number of factors, including but not limited to intended portion size and manufacturer's preferences. Consequently, the proportions and dimensions of packaging film usable to form the resealable package 200 may vary predictably based upon the package's final form factor. Notwithstanding, a general example of packaging film 300 is shown in more detail in FIG. 3 below, and one of ordinary skill in the art would recognize how to adapt the relative dimensions for bags of differing proportions.

Figure 3:
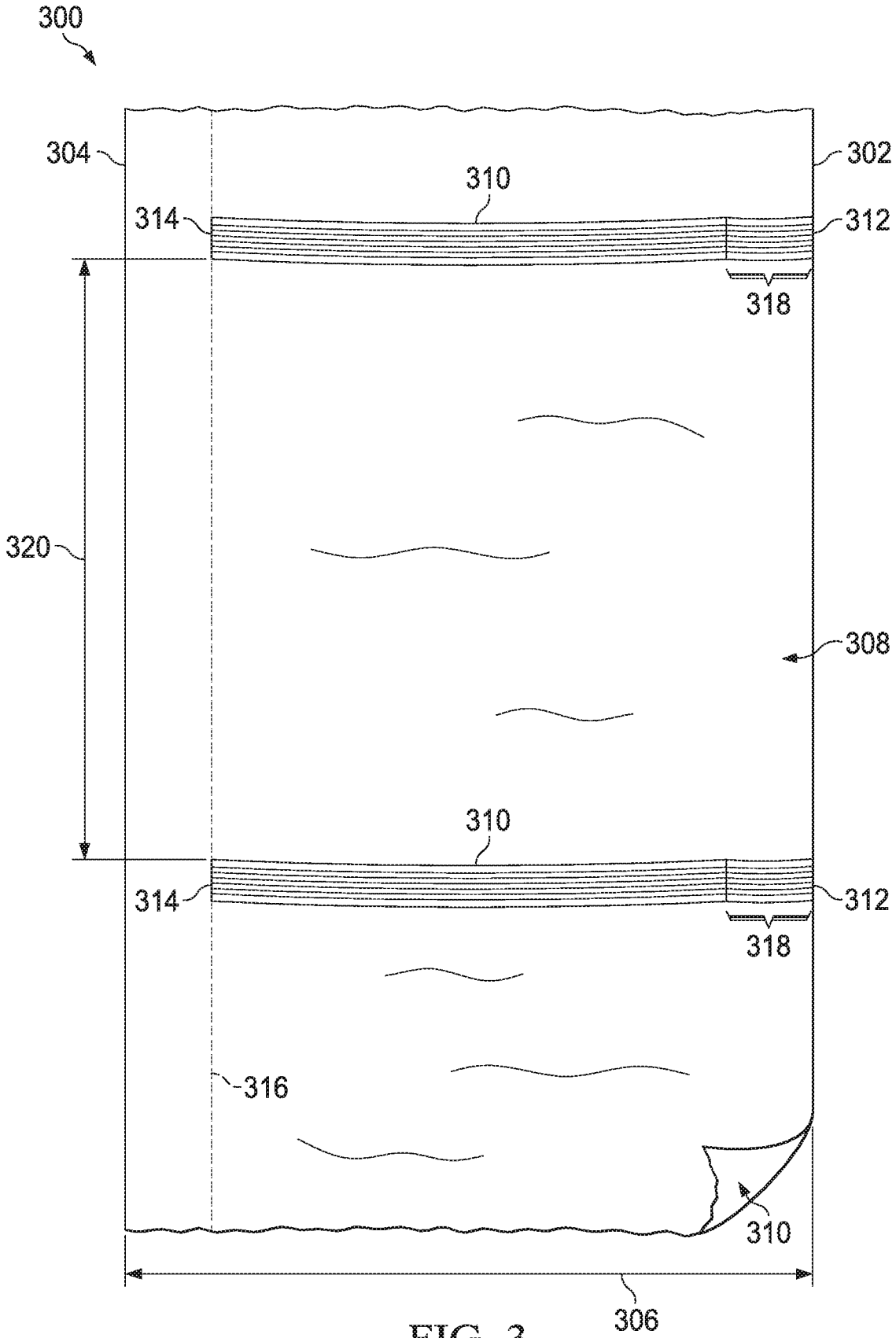
FIG. 3 depicts a packaging film configured for use in forming the resealable packages shown in FIGS. 2*a*-2*c*.

FIG. 3 illustrates a non-limiting embodiment of packaging film usable to form resealable package 200. Packaging film 300 includes a first longitudinal edge 302 separated from a second longitudinal edge 304 by a width 306. Additionally, packaging film 300 has a first side 308 and a second side 310, which eventually form the interior surface and exterior surface of the resealable package 200, respectively. Attached to the first side 308 of the packaging film 300 is one or more zipper strips 310.

In one embodiment, each zipper strip 310 has an elongate form that extends from the first longitudinal edge 302 towards the second longitudinal edge 304, but terminates at margin 316. Margin 316 is an imaginary line that serves as one border of a zipper-free area, which is bounded on the other side by the second longitudinal edge 304. The width of margin 316 may vary depending upon package dimensions, but the width will coincide approximately with the width of a back seal of the resultant package formed from packaging film 300.

In the embodiment where packaging film 300 includes a plurality of zipper strips 310, each zipper strip 310 is parallel with one another, separated by a uniform zipper distance 320. Although packaging film 300 depicts only two zipper strips 310, packaging film 300 may include substantially more provided that they are separated from one another by the same uniform zipper distance 320. Further, each zipper strip 310 is oriented perpendicularly relative to the longitudinal edges 302 and 304. More particularly, a first end 312 of each zipper strip 310 is aligned with the first longitudinal edge 302, and the second end 314 of each zipper strip 310 is aligned with the margin 316 located proximate to the second longitudinal edge 304.

Each zipper strip 310 is partially adhered to packaging film 300 using any conventional means. In one embodiment, an adhesive substance, such as glue, is used. Alternatively, the first side 308 of packaging film 300 may comprise a heat and/or pressure-activated film layer capable of adhering to another surface, such as an opposing surface of packaging film 300 or also to zipper strips 310. Thus, in another embodiment, zipper strips 310 may be adhered to the first side 308 of packaging film 300 by application of heat and pressure. In either event, during the adhering step, a length of zipper strip 310 is left unattached from the packaging film 300 at the first end 312 to form an unattached portion 318. Although the length of the unattached portion 318 may vary depending upon the final form factor of the resealable package 200, in some embodiments the length of the unattached portion 318 may generally correspond to the width of margin 316. However, in other non-limiting embodiments, the length of the margin is between 0.75-1.0 inches.

To form a resealable package 200 using packaging film 300, the first longitudinal edge 302 and second longitudinal edge 304 are brought together to form tube-like shape. The unattached portion 318 of zipper strip 310 is isolated from packaging film 300 while the back seal 204 is formed. Accordingly, the first longitudinal edge 302 and the second longitudinal edge 304 are permitted to maintain uninterrupted contact, and heat and pressure may be applied uniformly throughout the length of the back seal 204 to form a hermetic seal. After the seal is formed, the unattached portion of zipper strip 310 is allowed to re-engage the packaging film 300 over the newly formed back seal 204. Thereafter, the unattached portion 318 of zipper strip 310 is adhered to packaging film 300 by applying pressure, optionally in the presence of heat, to form zipper seal 202. In certain embodiments, if sufficient residual heat remains in the region of back seal 204, then the application of pressure in the absence of additional heat may be sufficient to attach the unattached portion 318 of zipper strip 310 to the packaging film 300 to form zipper seal 202.

To complete resealable package 200, a lower transverse 212 seal is created, which forms an open-ended bag. An optional amount of snack product may be introduced into the interior region 214 of resealable package 200 along with an inert gas before an upper transverse seal 210 is created. The completed resealable package 200 may then be separated from packaging film 300.

Lap Seal Example

To provide a clearer understanding of the relationship between the dimensions of packaging film 300 and the resealable package 200 that may be formed therefrom, a non-limiting example will be described. The resealable package 200 is a pillow pouch having a lap seal. This exemplary resealable package 200 has a width of 10.0 inches, a height of 15.5 inches, and a volume of 317.75 square inches. Further, the lap seal has an overlapping width of 0.5-0.625 inches.

The width 306 separating first longitudinal edge 302 from second longitudinal edge 304 is 0.625 inches. Each zipper strip 310 has a length of 20 inches and a width of 1.0 inch. The unattached portion 318 of zipper strip 310 has a length of 0.75-1.0 inch and each zipper strip 310 is separated from neighboring zipper strips by a zipper distance 320 of about 15.5 inches. Further, the zipper margin 316 has a length in the range of 0.5-0.625 inches.

One of ordinary skill would recognize that this lap seal example could be modified to accommodate a fin seal. For example, each end of the set of zipper strips 310 should be separated from a proximate longitudinal edge by a margin in the range of 0.5-0.625 inches. Thus, with reference to FIG. 3, the width 306 of the packaging film 300 would need to be extended by an amount corresponding to the width of margin 316 so that the first end 312 of zipper strip 310 is separated from longitudinal edge 302 by about 0.5-0.625 inches.

Figure 4:
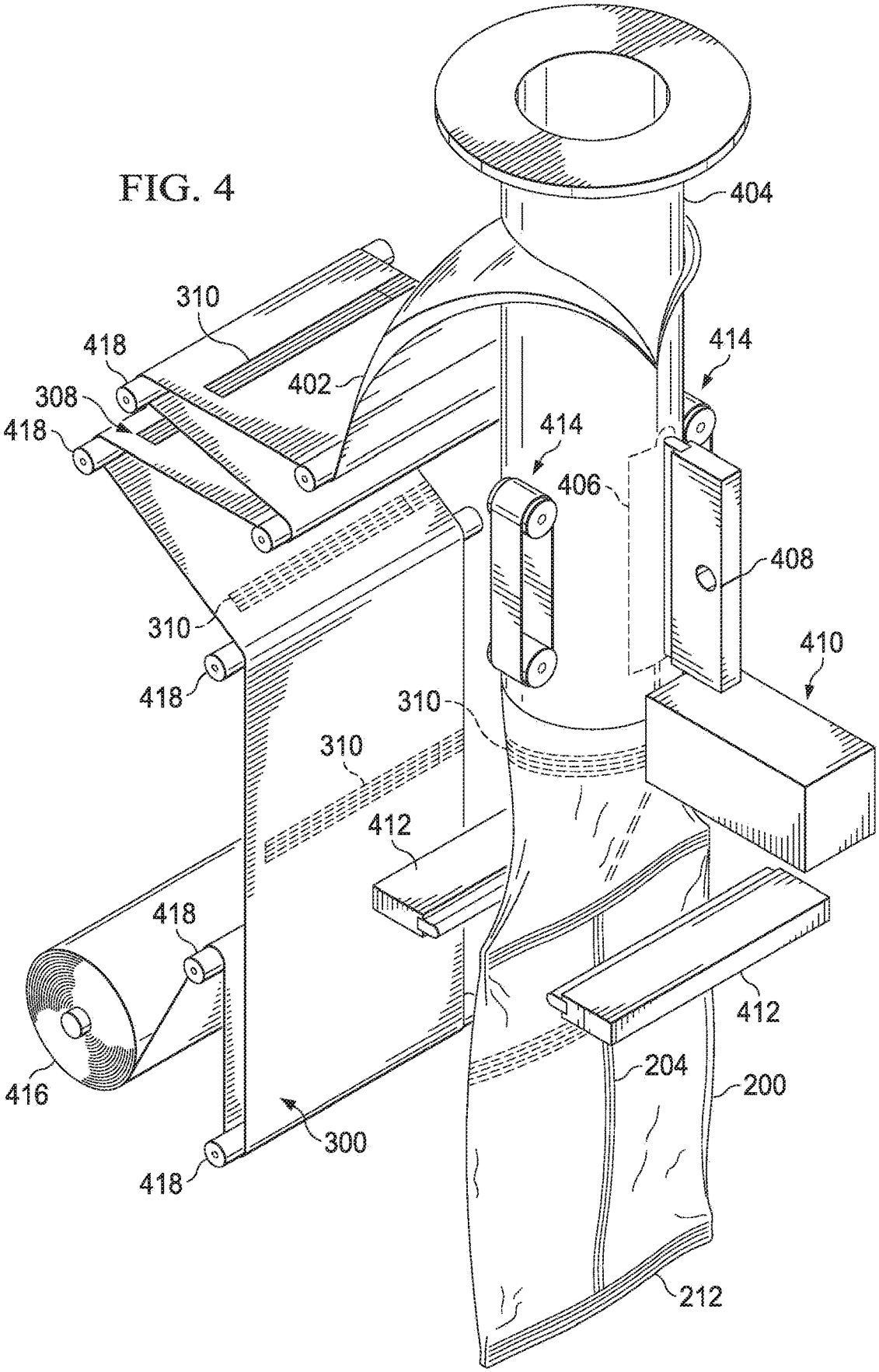
FIG. 4 depicts an improved vertical form, fill, and seal machine that can be used to transform the packaging film of FIG. 3 into the resealable packages of FIGS. 2*a*-2*c*.

FIG. 4 depicts an improved vertical form, fill, and seal machine in accordance with an illustrative embodiment. Vertical form, fill, and seal machine 400 is a machine capable of high-speed production of bags, such as resealable package 200 in FIGS. 2*a*-2*c*, from a roll of film, such as packaging film 300 in FIG. 3.

The depiction of vertical form, fill, and seal machine 400 is simplified and excludes the cabinet and support structures that typically enclose the machine, and some components may not be drawn to scale. Further, the terms "upstream" and "downstream" may be used to describe the relative placement of certain components of vertical form, fill, and seal machine 400, using the direction of product flow as reference. Thus, a component located towards the top of FIG. 4 is located upstream from a component located towards the bottom of FIG. 4.

Vertical form, fill, and seal machine 400 generally includes a forming collar 402 at least partially encompassing former 404. Attached to the outer surface of the former 404, downstream from the forming collar 402, is a zipper separation blade 406, which is sandwiched between the former 404 and a vertical sealer 408. Further downstream from zipper separation blade 406 is a zipper finisher 410, followed by a transverse sealer 412. Vertical form, fill, and seal machine 400 may also include one more pull belts 414 aligned with former 404 to advance packaging film 300 downstream along the body of former 404. The packaging film 300 is maintained on a roll 416 and fed through a series of tensioners 418 before receipt by the forming collar 402.

Vertical sealer 408 is a sealing apparatus that provides heat and pressure necessary to form back seal 204 in a resealable package 200. In a traditional vertical form, fill, and seal machine, a vertical sealer creates a back seal by pressing two layers of film together against the smooth, uninterrupted exterior surface of a former in the presence of heat. However, the vertical sealer 408 of vertical form, fill, and seal machine 400 is separated from contacting former 404 by zipper separation blade 406. Zipper separation blade 406 is an elongate component that isolates a zipper strip 310 during the back sealing process, which results in the formation of an uninterrupted, hermetic back seal 204 and a zipper seal 202 that spans the width of the resealable package 200.

Zipper separation blade 406 may be removably coupled to an outer surface of former 404 and oriented vertically so that its length is in the direction of product flow through former 404. The placement and orientation of zipper separation blade 406 on former 404 coincides with the path along which longitudinal edges 302 and 304 travel as they are formed into a back seal 204. Zipper separation blade 406 is shown in more detail in FIGS. 5*a*-5*c* that follow, and the interaction of zipper separation blade 406 with packaging film 300 during the back sealing process is shown in more detail in FIGS. 6*a*-6*d*.

Zipper finisher 410 is a mechanical device operable to adhere the unattached portion 318 of a zipper strip 310 to packaging film 300, over a newly formed back seal 204, by the application of pressure in the presence of heat. Zipper finisher 410 may take one of two different embodiments. In a first embodiment, zipper finisher 410 is an intermittent zipper finisher 700, as discussed in more detail in FIG. 7. In a second embodiment, zipper finisher 410 is a continuous zipper finisher 800, which is discussed in further detail in FIG. 8.

In operation, packaging film 300 is unwound from film roll 416 and passed through a set of tensioners 418 that maintain tension along a length of unwound packaging film 300. Packaging film 300 is directed over forming collar 402, which transitions the shape of the packaging film 300 from a substantially planar shape to a shape generally resembling a cross-section of former 404. The first side 308 of the packaging film 300 is generally in contact with the former 404 during the bag forming process, and the second side 310 of the packaging film 300 is outwardly exposed. In the non-limiting example of FIG. 4, former 404 has a circular cross-section; however former 404 may have an oval-like shape. The advancement of packaging film 300 along vertical form, fill, and seal machine 400 is controlled, at least in part, by one or more pull belts 414 during the bag-making process.

Packaging film 300 attains a generally tubular shape as it is wrapped around former 404. In particular, the tubular shape is achieved by overlapping the longitudinal edges 302 and 304 of packaging film 300, which are then sealed together by vertical sealer 408 to form a hermetic back seal 204. Importantly, as the back seal 204 is being formed, zipper separation blade 406 isolates an unattached portion 318 of a zipper strip 310 from packaging film 300 to prevent the unattached portion 318 from interfering with back seal formation. Upon completion of the back seal 204, the unattached portion 318 of zipper strip 310 reappears from behind the zipper separation blade 406 and reengages packaging film 300. Thereafter, zipper finisher 410 adheres the unattached portion 318 of the zipper strip 310 to packaging film 300 over the newly formed back seal 204 to form zipper seal 202. The zipper seal 202 has been formed within the interior region 214 of resealable package 200 and spans substantially the entire width of resealable package 200, such that the zipper seal 202 is contiguous from its first end to its second end with an allowance for manufacturing tolerances that may prevent the creation of a perfectly contiguous zipper seal 202.

The partially completed bag having a zipper seal 202 located within an interior region 214 may be completed using existing methods and apparatuses. For example, the partially completed bag may be advanced further downstream to a transverse sealer 412, which is depicted in this non-limiting embodiment of FIG. 4 as a pair of horizontal sealing jaws. However, in alternate embodiments, the transverse sealer 412 may take any alternate form, such as a continuous motion sealer. In either event, once a lower transverse seal 212 has been formed, product may be introduced into the resealable package 200 before the upper transverse seal 210 is added. Thereafter, a completed downstream bag 200 is separated from a partially completed upstream bag.

Figure 5A:
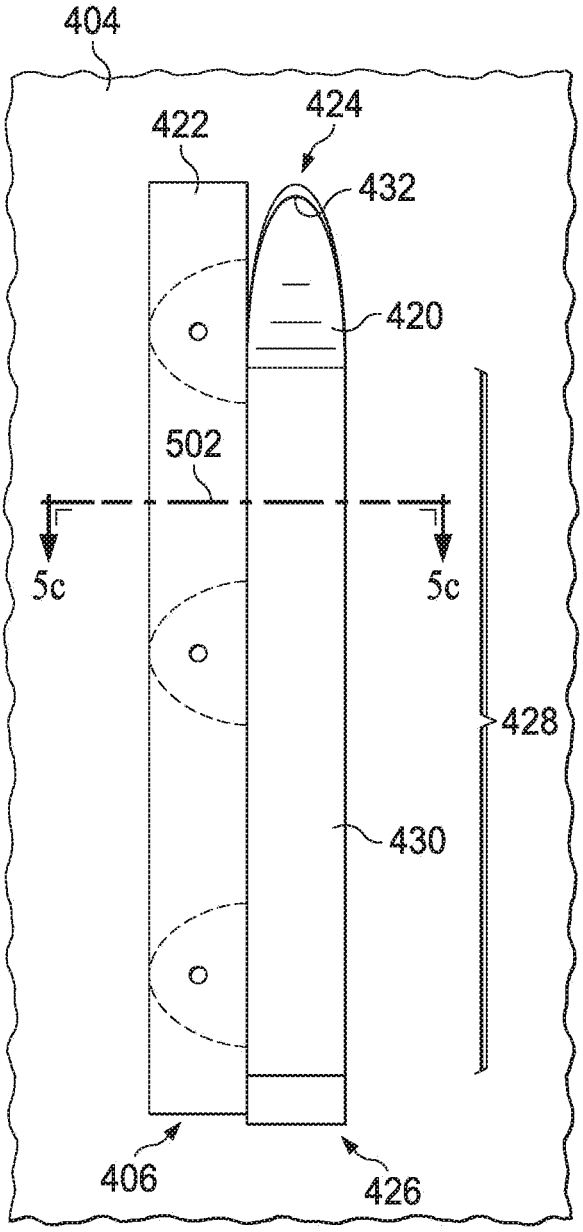
FIGS. 5*a*-5*c* depict multiple views of a zipper separation blade of the improved vertical form, fill, and seal machine depicted in FIG. 4.
Figure 5B:
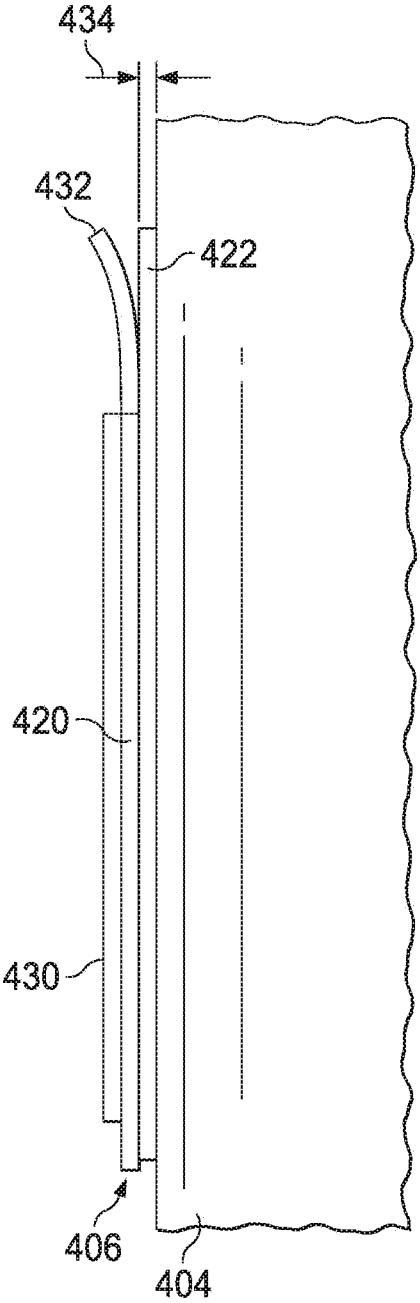
Figure 5C:
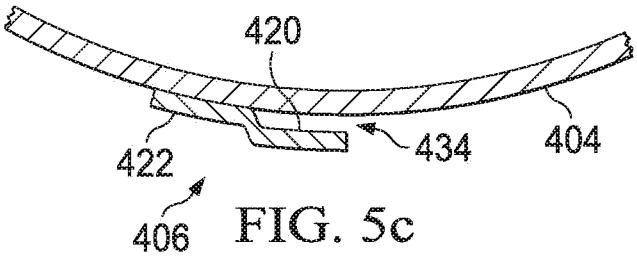

FIGS. 5*a*-5*c* depict various views of zipper separation blade 406 in accordance with an illustrative embodiment. Specifically, FIGS. 5*a* and 5*b* depict a front view of a zipper separation blade 406, and a right side view of zipper separation blade 406, respectively. FIG. 5*c* shows a cross-section of the zipper separation blade 406 taken along the corresponding dotted line of FIG. 5*a*.

The exemplary zipper separation blade 406 shown in FIG. 5*a* is formed generally from a blade body 420 and a connector 422 extending from the side of blade body 420. As can be seen, zipper separation blade 406 has an elongate shape with a length greater than a width.

Connector 422 is a component of zipper separation blade 406 that attaches blade body 420 to the outer surface of a former 404. In this non-limiting example, connector 422 has a series of apertures sized to receive a set of screws that can be used to attach blade body 420 to former 404. In another embodiment that utilizes screws for attaching zipper separation blade 406 to a former 404, connector 422 may take the form of a set of protrusions extending from the side of blade body 420, as depicted by the dotted lines extending from the side of blade body 420. In alternate embodiments, connector 422 may implement any number of currently existing or later developed fasteners to attach the blade body 420 to the exterior of the former. For example, connector 422 may implement magnets, adhesives, or other forms of mechanical fasteners.

In FIG. 5*a*, connector 422 is shown extending from a left side of blade body 420. However, in an alternate embodiment, connector 422 may extend outwardly from the right side of blade body 420. The relative location of connector 422 in relation to blade body 420 is dictated by the orientation of set of zipper strips 310 on packaging film 300 so that the zipper separation blade 406 may isolate the unattached portion 318 of a zipper strip 310. As an example, if the unattached portion 318 of a zipper strip 310 approaches the blade body 420 from the right, then the connector 422 should be located on the left side as shown in FIG. 5*a*-5*c*.

Blade body 420 has a first end 424 separated from a second end 426 by a middle portion 428 that is generally planar and may be covered by a heat resistant layer 430 that reduces heat transfer from a vertical sealer 408 to blade body 420. In this illustrative embodiment, heat resistant layer 430 is formed from a strip of hook and loop fasteners, such as Velcro®. However, in alternate embodiments, the heat resistant layer 430 may be formed from any existing or later developed material.

Located at the first end 424 of blade body 420 is knife lip 432. In the illustrative example of FIG. 5, knife lip 432 has a rounded leading edge. Rounded edges prevent the knife lip 432 from piercing the packaging film 300 passing zipper separation blade 406. However, knife lip 432 may include any number of shapes, such as a square or triangle.

The exemplary zipper separation blade 406 of FIG. 5 depicts a blade body 420 having a curvature at the first end 424 which facilitates the separation of an unattached portion 318 of a zipper strip 310 from packaging film 300. When zipper separation blade 406 is in the installed configuration, attached to a former 404, the first end 424 is curved away from the surface of the former 404. The curvature, which is more readily apparent in FIG. 5*b*, allows the knife lip 432 to pass closer to packaging film 300 than blade body 420, or even permits knife lip 432 to drag lightly along the surface of packaging film 300 to increase the likelihood of successfully separating the unattached portion 318 of a zipper strip 310 from packaging film 300 as the film is advanced past zipper separation blade 406.

When the zipper separation blade 406 is in the installed configuration and attached to a former 404, the outer surface of the former 404 and the opposing surface of blade body 420 forms a zipper gap 434. The zipper gap 434 is channel through which an unattached portion 318 of a zipper strip 310 can travel to maintain its isolation from packaging film 300 during the formation of the back seal 204. Zipper gap 434 has dimensions defined relative to zipper separation blade 406 and the outer surface of former 404. In particular, the zipper gap 434 has a length and width corresponding to the length and width of blade body 402, and a depth that corresponds to the distance of blade body 420 from the former 404.

In one embodiment, a length of blade body 420 varies based upon the size of the bag that is meant to be formed on the vertical form, fill, and seal machine 400. For example, larger bags require larger back seals 204, which require a longer blade body 420. Likewise, smaller bags require smaller back seals 204, which require a shorter blade body 420. The width of blade body 420 may vary predictably based upon the size of the resealable package being formed. Specifically, the width of the blade body 420 should correspond generally with the width of the back seal of the resealable package. Thus, in the back seal example disclosed above, the width of blade body 420 would be in the range of 0.5-0.625 inches.

FIG. 5*b* shows a side view of zipper separation blade 406 in an installed configuration, attached to former 404. Blade body 402 and connector 422 are generally planar, with the exception of the curvature at the first end 424. Further, as can be seen, the blade body 402 and the connector 422 are located in different planes so that when connector 422 is attached flush against the exterior of former 404, blade body 420 is separated from former 404 by a predefined distance, which corresponds to zipper gap 434.

FIG. 5*c* is shows a cross-sectional view of zipper separation blade 406 along line 5*c* shown in FIG. 5*a*. Connector 422, which is shown attached to former 404, has a curvature that corresponds to the exterior surface of former 404, which allows the connector 422 to sit flush against the outer surface of the former 404 when installed. In the event that zipper separation blade 406 is mounted on a flat portion of a former, then connector 422 may be entirely flat. In this non-limiting embodiment, connector 422 and blade body 420 are shown as an integrally formed component made from a single piece of metal or plastic. However, in an alternate embodiment, the blade body 420 may be formed separately from a connector 422 and then combined to create the zipper separation blade 406 using any method including but not limited to welding.

FIGS. 6*a*-6*d* depict a sequence of steps that illustrate the interaction of a zipper separation blade 406 with a zipper strip 310 during the formation of a back seal 204 and a zipper seal 202. In each of the FIGS. 6*a*-6*d*, packaging film 300 is wrapped around a former 404, and the longitudinal edges 302 and 304 are brought together and aligned with the blade body 420 to form back seal 204. For clarity, packaging film 300 is depicted as translucent so that zipper separation blade 406 can be seen clearly because the zipper separation blade 406 is usually obscured by the packaging film 300 during bag-making, as previously shown in FIG. 4. Additionally, in FIG. 6 the first side 308 of packaging film 300 is facing down and into the page, towards former 404 and the second side 310 of packaging film 300 is facing up and out of the page. The progression of the packaging film 300 downstream is evidenced by the relative location of the zipper strip 310 in relation to the zipper separation blade 406.

Figure 6C:
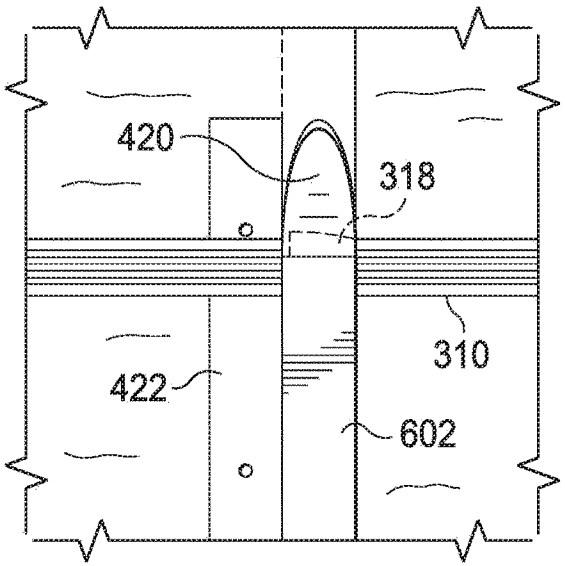
FIGS. 6*a*-6*d* depicts the interaction of the zipper separation blade with the packaging film of FIG. 3 during the formation of the resealable packages shown in FIGS. 2*a*-2*c*.
Figure 6B:
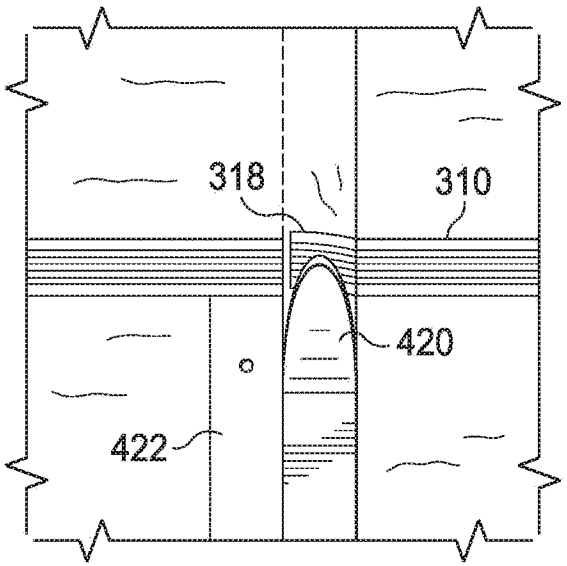
Figure 6A:
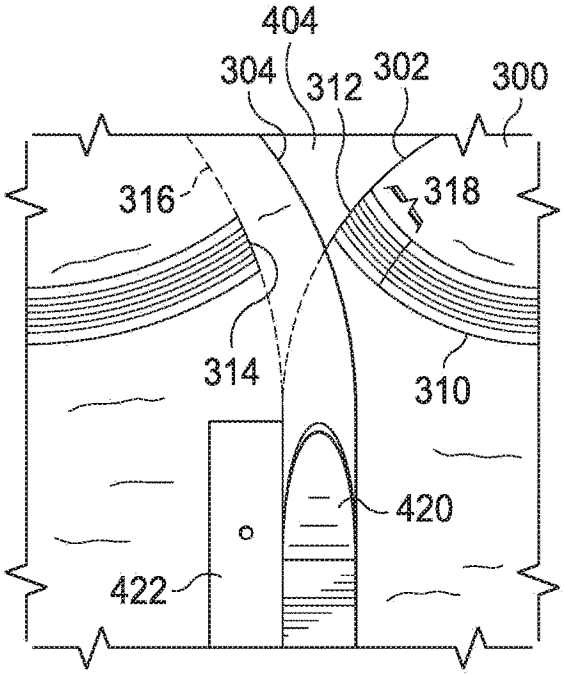

FIG. 6*a* shows the initial alignment of longitudinal edges 302 and 304 as packaging film 300 is advanced downstream. In particular, the packaging film 300 has recently been received around former 404 from a forming collar 402, which transforms the packaging film 300 into a tube-like shape in preparation of forming a back seal 204. A first end 312 of a zipper strip 310 is shown aligned with the first longitudinal edge 302 of the packaging film 300. The unattached portion 318, located at the first end 312 of the zipper strip, is also identified. The second end 314 of the zipper strip 310 is shown entering from the left and terminating at margin 316. The middle portion of zipper strip 310 (not shown) is located on an opposite side of former 404 and obscured from view in this drawing.

In FIG. 6*b*, the longitudinal edges 302 and 304 are fully overlapped in preparation of forming back seal 204. At this stage, knife lip 432 has separated the unattached portion 318 of zipper strip 310 from packaging film 300 so that the overlapping longitudinal edges 302 and 304 may be sealed against one another to form back seal 204 without interference from unattached portion 318.

FIG. 6*c* depicts the isolation of the unattached portion 318 of zipper strip 310 within a zipper gap 434 located between the zipper body 420 of zipper separation blade 406 and the outer surface of the former 404. Isolating the unattached portion 318 behind the zipper separation blade allows the two longitudinal edges 302 and 304 to maintain uninterrupted contact during the formation of a back seal 204 by the vertical sealer 408. Consequently, the unattached portion 318 of the zipper strip 310 cannot be sealed between the two longitudinal edges 302 and 304 of the back seal 204.

Vertical sealer footprint 602 shows the general positioning of the heat sealer band of vertical sealer 408 in relation to the zipper separation blade 406. In a non-limiting embodiment, vertical sealer footprint 602 coincides with the heat resistant layer 430 applied to zipper separation blade 406. As the packaging film 300 is advanced downstream, pressure is applied by the heat sealer band of the vertical sealer 408 in the presence of heat, within the vertical sealer footprint 602. The unattached portion 318 of the zipper strip 310 is isolated from the back sealing process by the zipper separation blade 406 to prevent any portion of the zipper strip 310 from interfering the back sealing process.

Another benefit of isolating the unattached portion 318 behind the zipper separation blade 406 during the formation of the back seal 204 is the provision of an uninterrupted, flat surface—provided by blade body 420—against which to form a back seal 204. Thus, even if the longitudinal edges 302 and 304 of the packaging film 300 could somehow be layered properly so that no portion of the zipper strip 310 is sandwiched between the two layers of film, the zipper strip 310 could still interfere with the back sealing process by providing an uneven surface against which the back seal 204 would be formed, which would prevent the heat sealer band of the vertical sealer 408 from contacting the entire surface area of the back seal region, particularly in the region contacting the zipper strip 310.

Figure 6D:
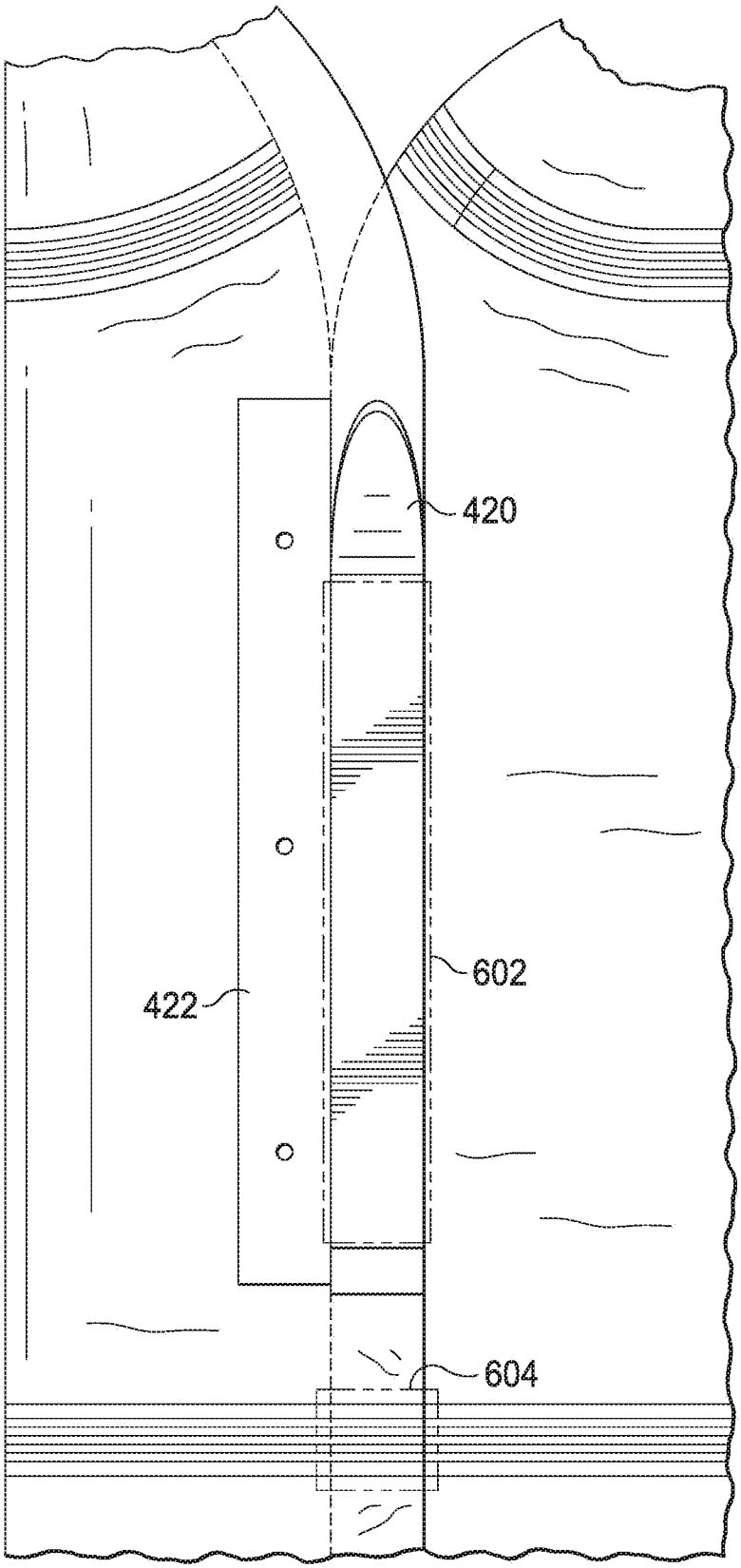

FIG. 6*d* depicts a location of a zipper finisher footprint 604 relative to the zipper separation blade 406 and vertical sealer footprint 602. The zipper finisher footprint 604 is an area that correspond with the approximate area of influence acted upon by the pressing surface of a zipper finisher 410 during the bag-making process, when the unattached portion 318 of the zipper strip 310 is sealed over the newly formed back seal 204, forming the zipper seal 202. The zipper finisher footprint 604 is located downstream from the vertical sealer footprint 602.

Although the zipper finisher footprint 604 is depicted as substantially square, the actual shape and dimension of the zipper finisher footprint 604 may vary depending upon the shape of the pressing surface of the zipper finisher. For example, the substantially square footprint depicted in FIG. 6*d* may correspond with the intermittent zipper sealer 700 depicted in FIG. 7 which is shown to have a substantially square pressing surface. However, the pressing surface may be any shape, such as a circle or a rectangle, which would alter the dimensions of the zipper finisher footprint 604.

Figure 7B:
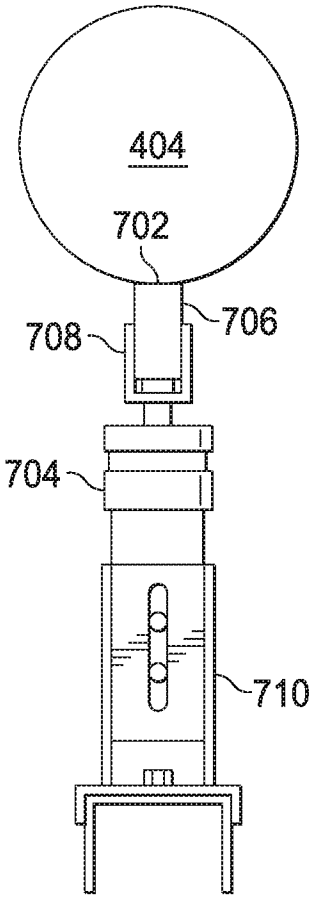
FIGS. 7*a* and 7*b* depict a zipper finisher in accordance with a first illustrative embodiment.
Figure 7A:
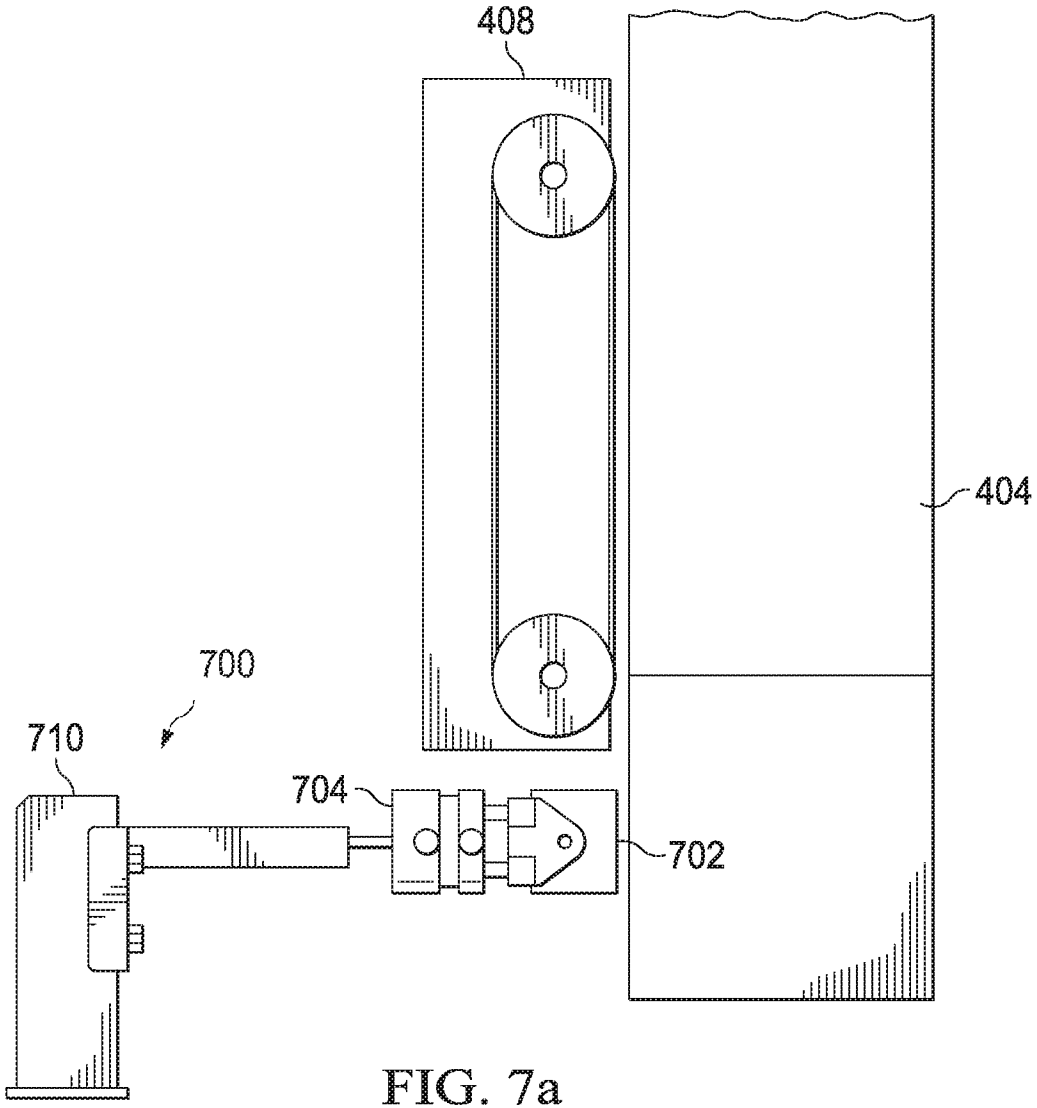

FIGS. 7*a* and 7*b* depicts alternate views of a zipper finisher, such as zipper finisher 410 in FIG. 4, in accordance with an illustrative embodiment. In particular, FIG. 7*a* is a side view of the intermittent zipper finisher 700, and FIG. 7*b* is a top view. Intermittent zipper finisher 700 has a pressing surface 702 coupled to an extending apparatus 704 that permits the pressing surface 702 to extend from a neutral position, depicted in FIG. 7*a*, to an extended position, as shown in FIG. 7*b*. In the neutral position, the pressing surface 702 is separated from the outer surface of former 404 by a predetermined distance sufficient to permit packaging film 300 to travel unimpeded between the pressing surface 702 and former 404. Conversely, in the extended position, the pressing surface 702 is capable of engaging the outer surface of former 404. Thus, during the operation of a vertical form, fill, and seal machine 400 to form a resealable package 200, the neutral position of intermittent zipper finisher 700 permits the packaging film 300 to advance downstream, and in the extended position, packaging film 300 is pressed between pressing surface 702 and the outer surface of former 404 to seal the unattached portion 318 to packaging film 300 across the back seal 204.

The operation of extending apparatus 704 is synchronized with the advancement of packaging film 300 so that intermittent zipper finisher 700 is in the extended position when the unattached portion 318 of a zipper strip 310 passes between pressing surface 702 and the outer surface of former 404. The synchronization may be achieved by any currently existing or later developed means. For example, intermittent zipper finisher 700 may be mechanically coupled to a vertical sealer 408 or one of the set of pull belts 414 so that the operation of intermittent sealer 700 is based on a speed by which packaging film 300 is advanced throughout a vertical form, fill, and seal machine 400. Alternatively, the operation of intermittent zipper finisher 700 may be managed by a computerized controller that also controls the other operational aspects of a vertical form, fill, and seal machine 400. In yet another embodiment, the synchronization of intermittent zipper finisher 700 may be achieved by implementing an optical or tactile sensor capable of detecting the location of the zipper strip 310 affixed to the packaging film 300 and triggering the intermittent zipper finisher 700 to assume the extended position.

Intermittent zipper finisher 700 may include an optional heating element 706 that transfers heat to the pressing surface 702 to form a heated pressing surface. As previously mentioned, an unattached portion 318 of a zipper strip 310 is adhered to packaging film 300 by applying pressure in the presence of heat. If the back seal region possesses sufficient residual heat from the back-sealing operation, then additional heat is unnecessary and the unattached portion 318 is adhered to the packaging film by the application of pressure. However, if the back seal region lacks sufficient residual heat, then heating element 706 provides heat to the pressing surface to facilitate the adhering process.

In a non-limiting embodiment, temperature probe 708 is coupled to the pressing surface 702 to determine whether additional heat is necessary for adequately adhering the unattached portion 318 of a zipper strip 310 to the packaging film 300. If the temperature falls below a threshold, then additional heat is required and heating element 706 provides additional heat to pressing surface 702. If the temperature probe 708 determines that the temperature of the pressing surface 702 is sufficiently high, then either the back seal region possesses adequate residual heat, or the pressing surface 702 itself has sufficient heat from the heating element 706. In either event, heating element 706 refrains from supplying additional heat and intermittent zipper finisher 700 is permitted to continue operating.

Intermittent zipper finisher 700 is attached to vertical form, fill, and seal machine 400 with mounting device 710. The mounting device 710 may be affixed to a structural support element of vertical form, fill, and seal machine 400 (not shown) or to any other component of vertical form, fill, and seal machine 400, such as a vertical sealer 408. Importantly, intermittent zipper finisher 700 should be located downstream from vertical sealer 408 to allow the vertical sealer 408 to complete the back seal 204 before the intermittent zipper finisher 700 completes the zipper seal 202 over the back seal 204.

Figure 8:
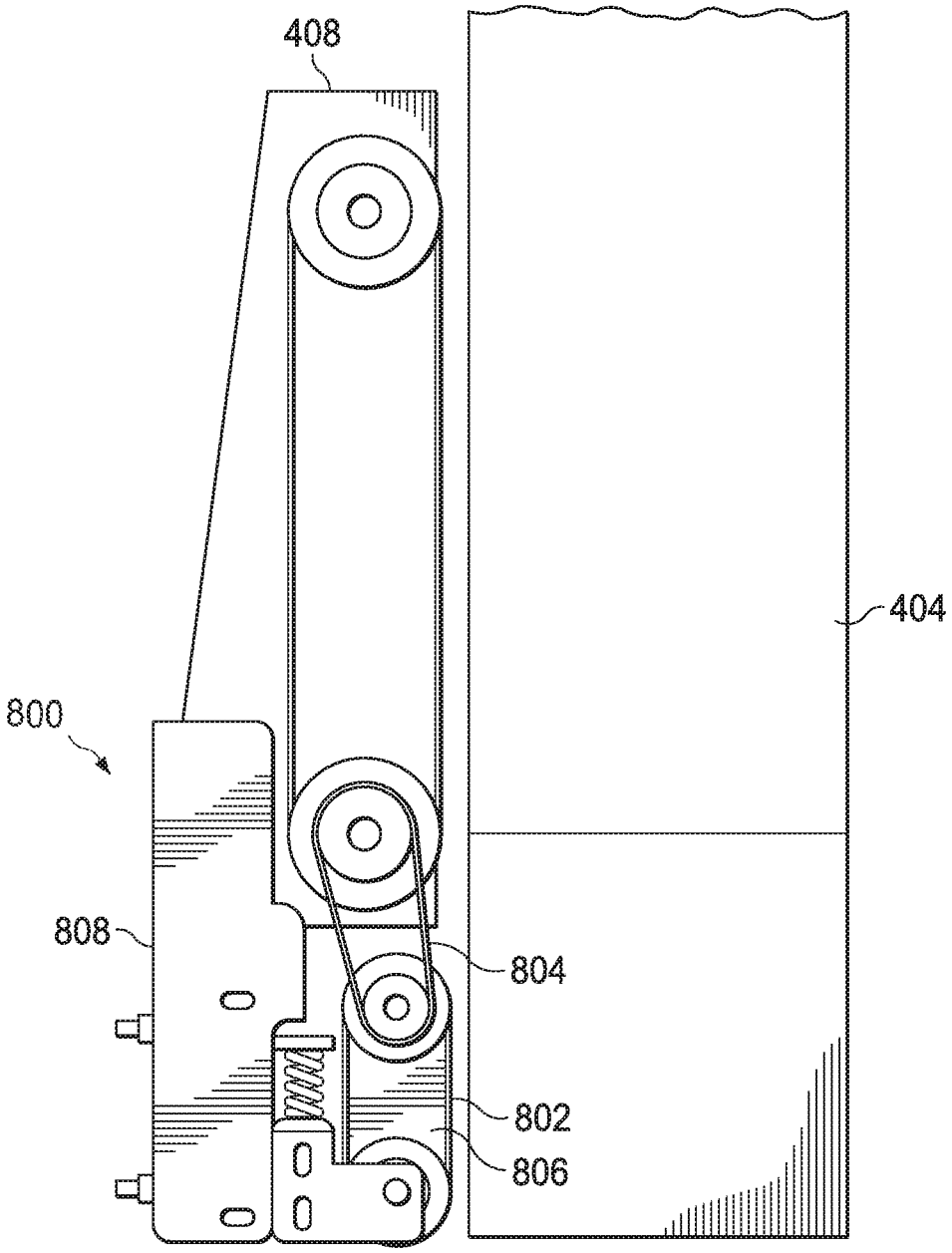
FIG. 8 depicts a zipper finisher in accordance with a second illustrative embodiment.

FIG. 8 depicts a zipper finisher, such as zipper finisher 410 in FIG. 4, in accordance with an illustrative embodiment. In particular, the zipper finisher of FIG. 8 is a continuous zipper finisher 800 having a pressing surface 802 applying constant pressure in the presence of heat to adhere an unattached portion 318 of a zipper strip 310 to packaging film 300. In the non-limiting embodiment of FIG. 8, the pressing surface 802 is a heat sealer band similar to the heat sealer band implemented in vertical sealer 408.

The operation of pressing surface 802 is synchronized so that packaging film 300 is advanced through a vertical form, fill, and seal machine 400 at a constant speed throughout. For example, if pressing surface 802 attempted to advance packaging film 300 faster than vertical sealer 408, then the packaging film could tear at a location between the vertical sealer 408 and the continuous zipper finisher 800. Conversely, if pressing surface 802 advanced packaging film 300 slower than vertical sealer 408, then the film could bunch in front of the continuous zipper finisher 800 and lead to jamming.

Thus, in this example pressing surface 802 is synchronized with vertical sealer 408 by timing belt 804. In particular, the rotational speed of pressing surface 802 is controlled by timing belt 804, which is in turn controlled by the rotational speed of heat sealer band of vertical sealer 408. In this manner, the speed of pressing surface 802 should be the same as that of the heat sealer band of vertical sealer 408. However, one of ordinary skill in the art would know that any number of synchronization methods could be substituted. As discussed above with respect to the intermittent zipper sealer 700, synchronization can occur by utilizing a computerized controller that also controls the speed of vertical sealer 408 along with the set of pull belts 414.

Continuous zipper finisher 800 may also include heating element 806, which provides heat to a pressing surface 802 in the event that the back seal region lacks sufficient residual heat from the back-sealing operation to enable adherence of the unattached portion 318 of the zipper strip 310 to the packaging film 300. As with the intermittent zipper finisher 700, the continuous zipper finisher 800 may also include a temperature probe (not shown) adjacent to or coupled with the pressing surface 802 for controlling the amount of heat provided by the heating element 806.

Continuous zipper finisher 800 is aligned with vertical sealer 408 so that the area of back seal 204 travels between the pressing surface 802 of the continuous zipper finisher 800 and the outer surface of the former 404. Shortly after the packaging film 300 passes the vertical sealer 408 and the knife blade 406, the unattached portion 318 of a zipper strip 310 reengages the packaging film 300 over the recently formed back seal 204. The unattached portion 318 is sealed over the back seal at the zipper finisher footprint 602 as the back seal travels between the pressing surface 802 and the outer surface of the former 404.

In the illustrative example of FIG. 8, continuous zipper sealer 800 is attached to the vertical sealer 408 by mounting device 808. However, in alternate embodiments, the continuous zipper sealer 700 may be affixed to another component of vertical form, fill, and seal machine 400, such as a structural support element.

Figure 9:
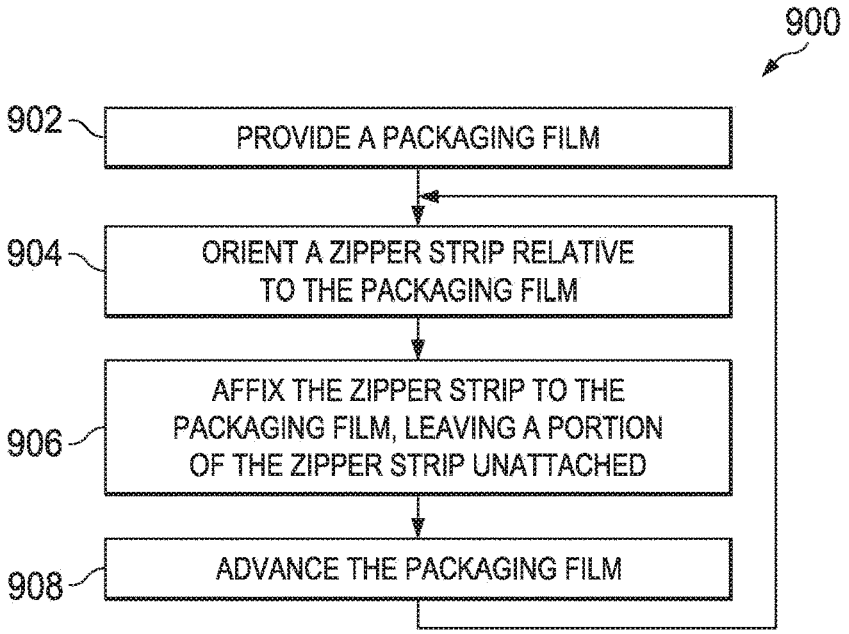
FIG. 9 is a flowchart of a process for forming the packaging film of FIG. 3 in accordance with an illustrative embodiment.

FIG. 9 is a flowchart of a process 900 for forming packaging film 300 in accordance with an illustrative embodiment. Packaging film is provided (step 902), and a zipper strip is oriented thereon relative to the film (step 904). In a non-limiting embodiment, the zipper strip is oriented with a first end aligned flush with a first longitudinal edge, and with the second end extending toward a second longitudinal edge, but with the second end terminating at a margin proximate to the second longitudinal edge. The zipper strip is affixed to the film, leaving a length of the zipper strip unattached at the first end to form an unattached portion (step 906). Thereafter, the film is advanced (step 908) and the process returns to step 904. In this manner, the film can be configured with one or more zipper strips to form packaging film 300 having a set of zipper strips 310 usable to form a plurality of resealable packages 200.

Figure 10:
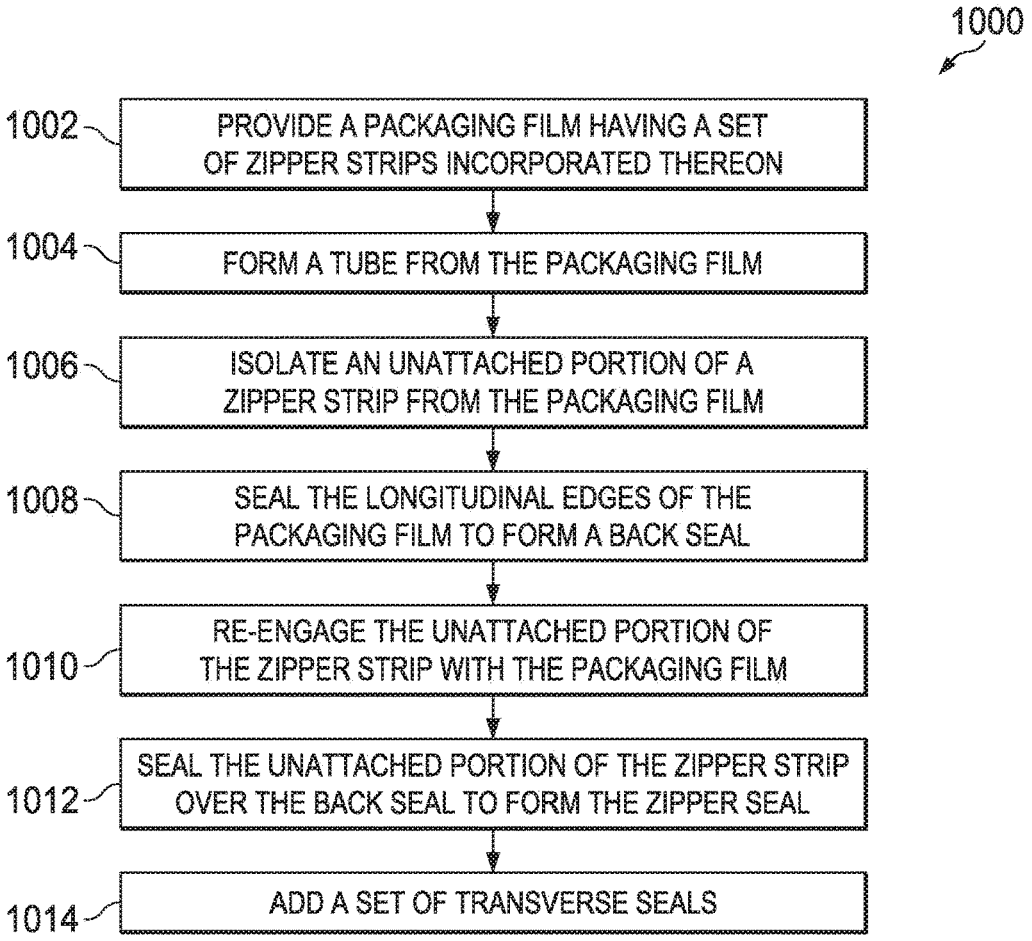
FIG. 10 is flowchart of a process for forming the resealable package of FIGS. 2*a*-2*c* using the packaging film of FIG. 3 in accordance with an illustrative embodiment.

FIG. 10 is a flowchart of a high-level process 1000 for forming a resealable bag 200 in accordance with an illustrative embodiment. The process begins by providing a packaging film having a set of zipper strips incorporated thereon, each of which includes an unattached portion located at a first end (step 1002). A tube is formed from packaging film (step 1004). The unattached portion of the zipper strip is isolated from the packaging film (step 1006), and longitudinal edges of the packaging film are sealed together to form a hermetic back seal (step 1008). The unattached end of the zipper strip is re-engaged with the packaging film at the newly formed back seal (step 1010), then the unattached end of the zipper strip is sealed over the back seal (step 1012). A set of transverse seals is added to the film to define the upper and lower ends of the bag (step 1014). Before adding the second transverse seal, an optional amount of food items may be placed within an interior region of the resealable package. Thereafter, certain embodiments of this process may require that the downstream bag is separated from the upstream bag at a transverse seal.

When process 1000 is implemented by a vertical form, fill, and seal machine 400, step 1002 further includes the step of feeding a roll of packaging film 300 into vertical form, fill, and seal machine 400. The tube created in step 1004 is achieved by passing the packaging film 300 over forming collar 402 and then around former 404. Zipper separation blade 406 isolates the unattached portion 318 of a zipper strip 310 from the packaging film 300 in step 1006 by first separating the unattached portion 318 from packaging film 300 using knife lip 432, then isolating the unattached portion 318 from the packaging film 300 by maintaining the unattached portion within a zipper gap 434. While the unattached portion 318 is isolated in the zipper gap 434, the longitudinal edges of packaging film 300 are sealed by vertical sealer 408 to form a hermetic back seal 204 at step 1008. The back seal 204 is formed by pressing the longitudinal edges 302 and 304 together between vertical sealer 408 and blade body 420 of zipper separation blade 406.

After the back seal 204 has been formed, the packaging film 300 is advanced past the blade body 420, thereby allowing the unattached portion 318 to re-engage the packaging film 300 at step 1010. A zipper finisher 410 located downstream from the zipper separation blade 406 adheres the unattached portion 318 of the zipper strip 310 to the packaging film 300 over the newly formed back seal 204 at step 1012. At least one transverse seal is added to a partially formed resealable package 200 at step 1014 by sealing jaws 412. Process 1000 may include one or more optional steps of adding product into the resealable package 200 before the upper transverse seal is added, then separating the completed and filled downstream bag from the upstream bag.

While this invention has been particularly shown and described with reference to certain embodiments, it will be understood by those skilled in the art that various changes in form and detail may be made therein without departing from the spirit and scope of the invention. For example, although the disclosure describes the use of zipper seals in pillow pouches, the inventive concepts provided herein may be applied to other types of packages utilizing different re-sealing mechanisms. Further, illustrative examples provided herein described the use of a vertical form, fill, and seal machine; however, alternate embodiments may also contemplate the use of a horizontal form, fill, and seal machine. Accordingly, the inventors expect skilled artisans to employ such variations as appropriate, and the inventors intend the invention to be practiced otherwise than as specifically described herein. Accordingly, this invention includes all obvious modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

ADDITIONAL DESCRIPTION

In a first embodiment, the disclosure describes a vertical form, fill, and seal machine for forming a resealable bag. The vertical form, fill, and seal machine includes a former, a vertical sealer, and a zipper separation blade coupled to the former and located between the former and the vertical sealer. The zipper separation blade also includes a connector coupled to a blade body. In addition, the zipper separation blade defines a zipper gap between an exterior surface of the former and the blade body Another embodiment including any one or more of the elements in a previous embodiment disclosed above, wherein the vertical form, fill, and seal machine further comprises a zipper finisher located downstream from the zipper separation blade.

Another embodiment including any one or more of the elements in a previous embodiment disclosed above, wherein the zipper finisher is a continuous zipper finisher.

Another embodiment including any one or more of the elements in a previous embodiment disclosed above, wherein the continuous zipper finisher further comprises a timing belt coupling the continuous zipper finisher with the vertical resealer.

Another embodiment including any one or more of the elements in a previous embodiment disclosed above, wherein the continuous zipper finisher further comprises a pressing surface in continuous contact with a back seal region with a resealable package during formation of the resealable package.

Another embodiment including any one or more of the elements in a previous embodiment disclosed above, wherein the continuous zipper finisher further comprises a heating element coupled to the pressing surface.

Another embodiment including any one or more of the elements in a previous embodiment disclosed above, wherein the zipper finisher is an intermittent zipper finisher.

Another embodiment including any one or more of the elements in a previous embodiment disclosed above, wherein the intermittent zipper finisher further comprises a pressing surface and an extending apparatus coupled to the pressing element, wherein the extending apparatus extends the pressing surface to engage a packaging film.

Another embodiment including any one or more of the elements in a previous embodiment disclosed above, wherein the intermittent zipper finisher further comprises a heating element coupled to the pressing surface.

Another embodiment including any one or more of the elements in a previous embodiment disclosed above, wherein the zipper separation blade further comprises a first end of the blade body separated from a second end by a middle portion that defines a first plane and wherein the connector defines a second plane that is different than the first plane.

Another embodiment including any one or more of the elements in a previous embodiment disclosed above, wherein the first end of the zipper separation blade comprises a rounded knife lip.

Another embodiment including any one or more of the elements in a previous embodiment disclosed above, wherein a length of the blade body between the middle portion and the first end further comprises a curved surface projecting away from the former.

Another embodiment including any one or more of the elements in a previous embodiment disclosed above, wherein the zipper separation blade further comprises a heat-resistant layer covering at least a portion of the blade body between a first end and a second end.

Another embodiment including any one or more of the elements in a previous embodiment disclosed above, wherein the zipper separation blade comprises a length between 11-22 inches.

Another embodiment including any one or more of the elements in a previous embodiment disclosed above, wherein the connector and the blade body are integrally formed.

Another embodiment including any one or more of the elements in a previous embodiment disclosed above, wherein the connector comprises at least one aperture sized to receive a screw.

Another embodiment including any one or more of the elements in a previous embodiment disclosed above, wherein the connector comprises a length longer than a width, and wherein the connector comprises a curvature along the width that coincides with a corresponding curvature of the former.

In a second embodiment, the disclosure describes a method for forming a resealable bag on a vertical form, fill, and seal machine from a film comprising a set of zipper strips; the vertical form, fill, and seal machine including a zipper separation blade; and the method comprising wrapping a packaging film around a former to form a tube of film, isolating the unattached portion within a zipper gap while forming the back seal, and rejoining the unattached portion of the first zipper strip over the newly formed back seal.

Another embodiment including any one or more of the elements in a previous embodiment disclosed above, wherein the isolating step further comprises separating an unattached portion of a first zipper strip from the tube of film using a knife lip of the zipper separation blade.

Another embodiment including any one or more of the elements in a previous embodiment disclosed above, wherein forming the back seal further comprises sealing a first longitudinal edge with a second longitudinal edge against a flat surface provided by a blade body of the zipper separation blade.

Another embodiment including any one or more of the elements in a previous embodiment disclosed above, wherein the rejoining step further comprises advancing the film downstream past the zipper separation blade to allow the unattached portion to contact the packaging film over the back seal.

Another embodiment including any one or more of the elements in a previous embodiment disclosed above, wherein the rejoining step further comprises sealing the unattached portion of the zipper strip over the back seal.

Another embodiment including any one or more of the elements in a previous embodiment disclosed above, wherein the method further comprises adding a set of transverse seals.

In a third embodiment, the disclosure describes resealable package comprising a front panel, a rear panel opposite the front panel, an upper transverse seal located at an upper end of the resealable package, wherein the upper transverse seal extends a width between a first longitudinal edge and a second longitudinal edge, a lower transverse seal located at a lower end of the resealable package, opposite the upper transverse seal, a hermetic back seal extending along the back panel from the top transverse seal to the bottom transverse seal, an interior region bounded by the front panel and the back panel, an a zipper seal located within the interior region that spans the width of the resealable package.

Another embodiment including any one or more of the elements in a previous embodiment disclosed above, wherein the zipper seal is oriented parallel to the top transverse seal.

Another embodiment including any one or more of the elements in a previous embodiment disclosed above, wherein the zipper seal is located in the upper half of the resealable package.

Another embodiment including any one or more of the elements in a previous embodiment disclosed above, wherein the zipper seal is located between 1-2 inches from the top transverse seal.

Another embodiment including any one or more of the elements in a previous embodiment disclosed above, wherein the zipper seal intersects the hermetic back seal.

Another embodiment including any one or more of the elements in a previous embodiment disclosed above, wherein the zipper seal comprises a first operative surface attached to an interior surface of the front panel, a second operative surface attached an interior surface of the back panel, and wherein the first operative surface is aligned oppositely from the second operative surface.

In a fourth embodiment, the disclosure describes a packaging film for forming a resealable package, the film comprising a first side, a second side opposite the first side, and a set of zipper strips partially adhered to the first side. Each of the set of zipper strips extends from a first longitudinal edge towards a second longitudinal edge but terminates at a margin offset inwardly from the second longitudinal edge, and a predetermined length of each zipper strip in the set of zipper strips is unattached to the packaging film at a first end to form an unattached portion.

Another embodiment including any one or more of the elements in a previous embodiment disclosed above, wherein the set of zipper strips comprise a plurality of zipper strips, and wherein each of the plurality of zipper strips are arranged in regularly repeating intervals.

Another embodiment including any one or more of the elements in a previous embodiment disclosed above, wherein the margin is located a distance of 0.5-0.625 inches from the second longitudinal edge.

Another embodiment including any one or more of the elements in a previous embodiment disclosed above, wherein a length of the unattached portion is between 0.75-1.0 inches.

In a fifth embodiment, the disclosure describes a method for creating a packaging film to form a resealable package, the method comprising the steps of providing a film comprising a first side bounded by a first longitudinal edge and a second longitudinal edge parallel to the first longitudinal edge, and partially adhering a first zipper strip to the first side, oriented perpendicularly from the first longitudinal edge and the second longitudinal edge, wherein a first end of the first zipper strip is aligned with the first longitudinal edge, and the second end is aligned with a margin offset inwardly from the second longitudinal edge, and wherein a length of the first zipper strip at the first end remains unattached from the first side of the film to form an unattached portion.

Another embodiment including any one or more of the elements in a previous embodiment disclosed above, wherein the method further comprises partially affixing a second zipper strip to the first side, wherein the second zipper strip is oriented parallel to the first zipper strip and located a predetermined distance from the first zipper strip.

Another embodiment including any one or more of the elements in a previous embodiment disclosed above, wherein the method further comprises adhering the first zipper strip to the first side by applying pressure and heat along a length of the zipper strip but excluding the unattached portion.

Another embodiment including any one or more of the elements in a previous embodiment disclosed above, wherein the method further comprises advancing the packaging film a predetermined distance, and partially affixing a second zipper strip to the first side.

We claim:

1. A vertical form, fill, and seal machine for forming a resealable bag from a packaging film, the vertical form, fill, and seal machine comprising:

a former having a tubular portion, the former configured to form a tube of film from the packaging film as the packaging film is wrapped around the tubular portion of the former, and the former configured to serve as a filling tube for filling the resealable bag with a product;

a vertical sealer configured to seal together overlapping longitudinal edges of the tube of film when the tube of film is wrapped around the tubular portion of the former, the tube of film being provided with a lateral zipper strip arranged orthogonal to the overlapping longitudinal edges and having an unattached portion that overlaps the overlapping longitudinal edges of the tube of film;

a zipper separation blade coupled to the former and located between the tubular portion of the former and the vertical sealer, wherein the zipper separation blade comprises a connector and a blade body, the connector coupled to the blade body, wherein the zipper separation blade defines a zipper gap between an exterior surface of the former and the blade body, and wherein the vertical form, fill and seal machine and the zipper separation blade are configured to position the unattached portion of the zipper strip in the zipper gap and thereby isolate the unattached portion of the zipper strip from the overlapping longitudinal edges of the tube of film, wherein the unattached portion of the zipper strip is not located between the overlapping longitudinal edges as the vertical sealer seals together the overlapping longitudinal edges.

2. The vertical form, fill, and seal machine of claim 1, further comprising: a zipper finisher located downstream from the zipper separation blade.

3. The vertical form, fill, and seal machine of claim 2, wherein the zipper finisher is a continuous zipper finisher.

4. The vertical form, fill, and seal machine of claim 3, wherein the continuous zipper finisher further comprises: a timing belt coupling the continuous zipper finisher with the vertical resealer.

5. The vertical form, fill, and seal machine of claim 3, wherein the continuous zipper finisher further comprises: a pressing surface in continuous contact with a back seal region of the resealable bag during formation of the resealable bag.

6. The vertical form, fill, and seal machine of claim 5, wherein the continuous zipper finisher further comprises a heating element coupled to the pressing surface.

7. The vertical form, fill, and seal machine of claim 2, wherein the zipper finisher is an intermittent zipper finisher.

8. The vertical form, fill, and seal machine of claim 7, wherein the intermittent zipper finisher further comprises: a pressing surface; and an extending apparatus coupled to the pressing surface, wherein the extending apparatus extends the pressing surface to engage the packaging film.

9. The vertical form, fill, and seal machine of claim 8, wherein the intermittent zipper finisher further comprises: a heating element coupled to the pressing surface.

10. The vertical form, fill, and seal machine of claim 1, wherein the zipper separation blade further comprises: a first end of the blade body separated from a second end by a middle portion that defines a first plane; and wherein the connector defines a second plane that is different than the first plane.

11. The vertical form, fill, and seal machine of claim 10, wherein the first end of the zipper separation blade comprises a rounded knife lip.

12. The vertical form, fill, and seal machine of claim 11, wherein a length of the blade body between the middle portion and the first end further comprises a curved surface projecting away from the former.

13. The vertical form, fill, and seal machine of claim 1, wherein the zipper separation blade further comprises: a heat-resistant layer covering at least a portion of the blade body between a first end and a second end.

14. The vertical form, fill, and seal machine of claim 1, wherein the zipper separation blade comprises a length between 11-22 inches.

15. The vertical form, fill, and seal machine of claim 1, wherein the connector and the blade body are integrally formed.

16. The vertical form, fill, and seal machine of claim 1, wherein the connector comprises at least one aperture sized to receive a screw.

17. The vertical form, fill, and seal machine of claim 1, wherein the connector comprises a length longer than a width, and wherein the connector comprises a curvature along the width that coincides with a corresponding curvature of the former.

* * * * *